US006244081B1

(12) United States Patent
Schlipper

(10) Patent No.: US 6,244,081 B1
(45) **Date of Patent: *Jun. 12, 2001**

(54) SECURITY DEVICE FOR LUGGAGE

(76) Inventor: Robert Wesley Schlipper, GPO Box 11464, Hong Kong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 09/504,597

(22) Filed: Feb. 15, 2000

Related U.S. Application Data

(63) Continuation of application No. 09/063,682, filed on Apr. 22, 1998, now Pat. No. 6,026,662.

(51) Int. Cl.[7] ..... E05B 73/00
(52) U.S. Cl. ..... 70/18; 70/14; 70/49; 70/65
(58) Field of Search ..... 70/14, 18, 19, 70/30, 49, 64, 65; 24/16 PB; 292/307 B, 318

(56) References Cited

U.S. PATENT DOCUMENTS

| | | | | |
|---|---|---|---|---|
| 1,176,510 | * | 3/1916 | Young | 70/65 |
| 1,201,972 | * | 10/1916 | Kelly | 70/65 X |
| 1,982,813 | * | 12/1934 | Jacobi | 70/65 |
| 3,756,008 | | 9/1973 | Smith . | |
| 3,783,656 | | 1/1974 | Foote . | |
| 3,798,934 | | 3/1974 | Wright et al. . | |
| 3,831,407 | | 8/1974 | Coleman . | |
| 4,024,738 | | 5/1977 | Pi . | |
| 4,057,982 | * | 11/1977 | Drayton et al. | 70/18 X |
| 4,063,637 | | 12/1977 | Danforth . | |
| 4,157,602 | | 6/1979 | Pennell . | |
| 5,031,641 | | 7/1991 | Upton . | |
| 5,070,712 | | 12/1991 | Fox . | |
| 5,181,402 | * | 1/1993 | Faessler et al. | 70/18 |
| 5,279,135 | | 1/1994 | Leyden et al. . | |
| 5,582,043 | | 12/1996 | McCue et al. . | |
| 6,026,662 | * | 2/2000 | Schlipper | 70/65 X |
| 6,077,587 | * | 6/2000 | Potok | 70/65 X |
| 6,092,401 | * | 7/2000 | Sankey et al. | 70/49 X |

FOREIGN PATENT DOCUMENTS

| | | | | |
|---|---|---|---|---|
| 431377 | * | 11/1911 | (FR) | 70/65 |

* cited by examiner

*Primary Examiner*—Suzanne Dino Barrett

(57) ABSTRACT

A security device, for a backpack 51, comprises a cover in the form of a wire netting 50 that is held snugly to the backpack by a draw line 53. The draw line is taughtened and locked tight with a locking mechanism 54. The cover prevents tampering with or removing the backpack from the wearer, and especially the slicing open of backpack to remove its contents.

4 Claims, 11 Drawing Sheets

SECURITY DEVICE FOR LUGGAGE

CROSS-REFERENCE TO RELATED PATENT APPLICATION

The present application is a continuation of U.S. patent application Ser. No. 09/063,682, filed Apr. 22, 1998 now U.S. Pat. No. 6,026,662.

FIELD OF THE INVENTION

The present invention relates to security devices for luggage.

DESCRIPTION OF THE PRIOR ART

The security devices according to the invention have been devised particularly, although not solely, for travellers having luggage which is exposed to tampering or theft. The devices are particularly suitable for use with luggage such as rucksacks and other luggage packs which are carried by backpackers and low budget travellers.

A backpack is vulnerable to tampering, even when being worn on the back of a backpacker, as it is exposed and is out of sight of the backpacker. A thief may obtain access to the contents of the backpack simply by cutting the backpack. Additionally, when removed from the back of a backpacker, a backpack can be easily stolen if not held securely by the backpacker.

SUMMARY OF THE INVENTION

The present invention seeks to provide security devices for an article of luggage such as a backpack or hand-carriable travel pack which restricts unauthorized access to the article of luggage.

According to one aspect of the invention there is provided a security device for an article of luggage comprising a flexible cover adapted to surround or provide a container for articles of luggage, the device comprising a wire netting container having a peripheral opening formed by closed looped ends of parts of the netting, and a draw line for closing the device which is threaded through the open looped ends and arranged to draw the loops inwardly towards each other to close off or at least to effectively reduce the size of the opening, and a locking mechanism arranged to act on the draw line to prevent opening of the device.

The netting may be formed by one or more strands of metal wire in which adjacent parts of the strand are held together side-by-side at intervals along their lengths by metal clips or injection moulded ferrules in situ.

The netting may be formed as three separate nets generally shaped to extend over three lengthwise surfaces, a top surface, and a bottom surface of the luggage compartment respectively, the remaining lengthwise side surface corresponding to the opening of the device, and in which the three nets are joined together by clips or ferrules to form the completed device.

The locking mechanism may comprise a body anchored adjacent one end of the draw line and incorporates a brake to releasably and selectively secure the other end of the draw line to prevent unauthorized opening of the device.

The other end of the draw line may be fitted with spaced apart beads that can pass through an aperture in the body when the draw line is pulled through to close the opening, and arranged to receive lock shackle that fits through the aperture to prevent beads passing through the aperture whenever the shackle is in the aperture.

The netting may be supported between opposing layers of material, such as canvas or plastic, that constitute in whole or in part the container for the articles.

The draw line may have provision for tethering to a fixture to assist in preventing theft of the article of luggage when not being carried or otherwise held by a user. The draw line may also have a further section extending beyond a closed loop for anchoring the receptacle to a fixture thereby to protect the article of luggage against theft. The further section of the draw line may be adapted to be attached directly to the fixture, or to pass around the fixture and to be returned and releasably affixed to the cable.

The netting is preferably arranged to collapse into a compact condition for storage when not in use.

The netting may extend around a plurality of articles of luggage, or an article of luggage and some other loose article such as a sleeping bag if desired. The security device may be equally important to prevent illicit substances being "slipped" inside the backpack by criminals so that the backpack user might inadvertently carry such substances through a frontier at considerable danger to arrest and criminal prosecution.

According to another aspect of the invention there is provided a method of making security devices for luggage which includes winding a strand of metal wire in a zigzag array over pairs of spaced apart opposing pegs, bringing adjacent strands together in pairs at distance intervals between the opposing pegs and fixing the strands together, and lifting the fixed together strand off the pegs to perform the netting.

BRIEF DESCRIPTION OF THE DRAWINGS

Security devices according to the invention will now be described by way of example with reference to the accompanying drawings in which.

DETAILED DESCRIPTION OF THE PREFERRED EMBODIMENT

Figure 1:
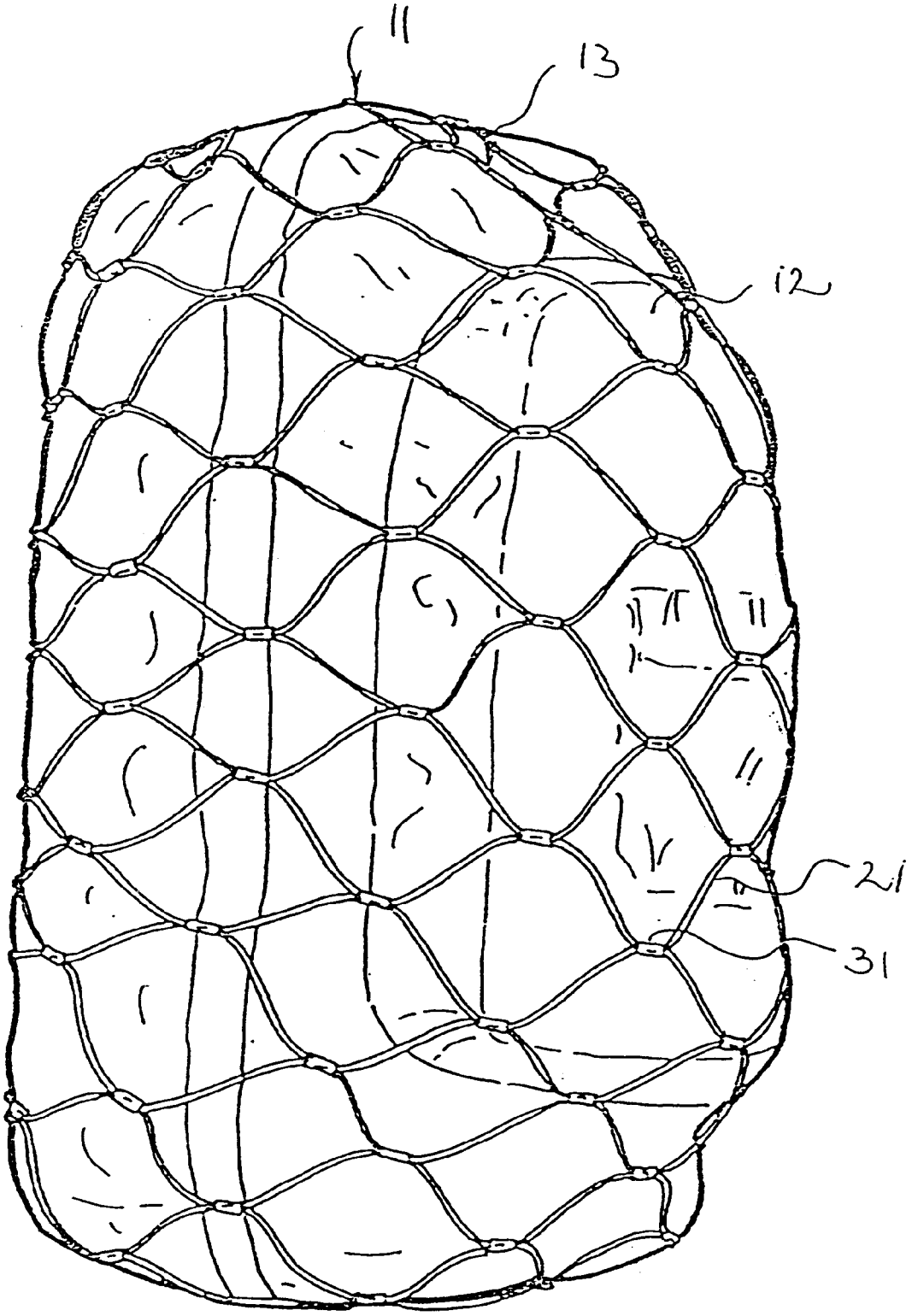
FIG. 1 is a side view of a backpack fitted with a security device.

Referring to the drawings, in FIGS. 1–4, a security device 11 for a backpack 12 comprises a cover 13 in the form of a netting configured as a receptacle having an opening 15 and a peripheral edge 17 surrounding the opening.

The net structure forming the cover 13 is constructed from a first strand 21 and a second strand 22, each comprising a length of wire cable. The second strand 22 is arranged in a generally circular formation incorporating a loop 23 formed with a 15 ferrule 25.

The first thread 21 is wound into a mesh by turning it back on itself in sequence to provide closed loops 27 at the peripheral edge 17. The thread 21 is retained together at nodes of the netting by ferrules 31 received on and secured to the strand. The netting formed by the first strand 21 is attached to the circular formation provided by the second strand 22 by ferrules 33.

Figure 3:
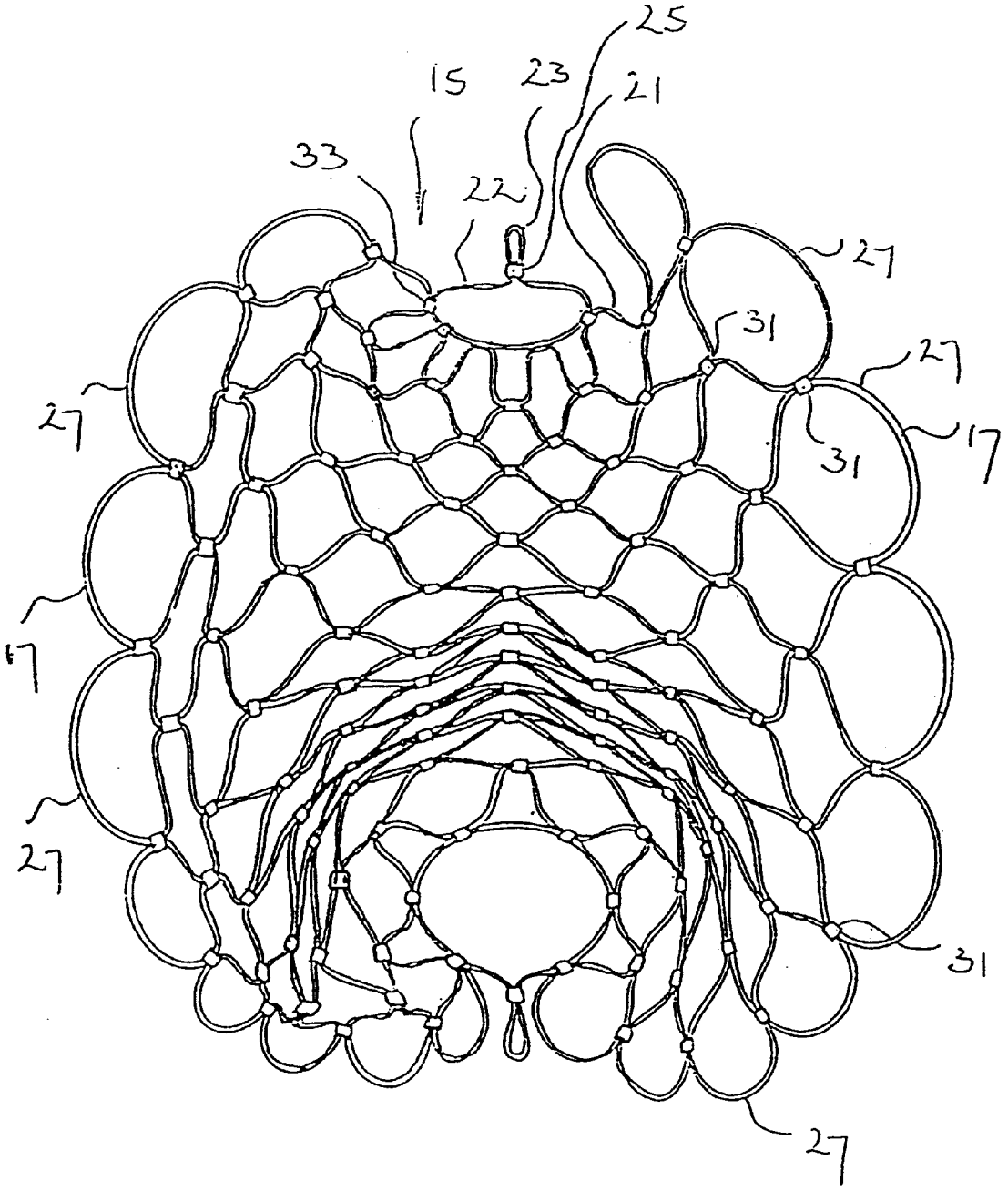
FIG. 3 is a perspective view of the security device shown in an expanded condition.
Figure 4:
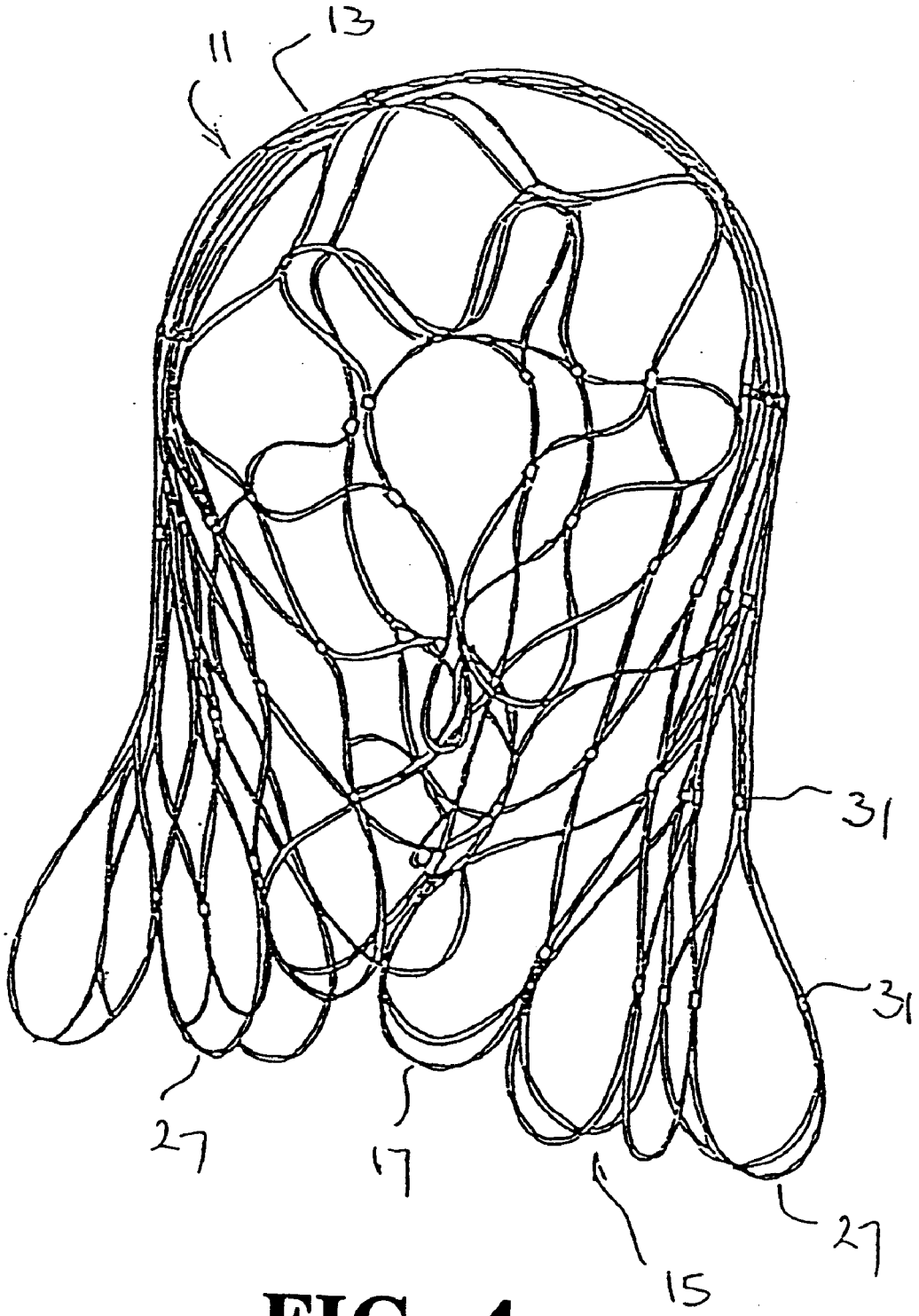
FIG. 4 is a view of the security device shown in a collapsed condition.

The arrangement in which the first strand 21 is wound back and forth to create the netting allows the cover 31 to assume an expanded condition (as shown in FIG. 3) ready to receive a backpack and a collapsed condition (as shown in FIG. 4) when not in use. From the collapsed condition, the cover can be folded about itself into a more compact condition (not shown) for convenient storage.

Figure 2:
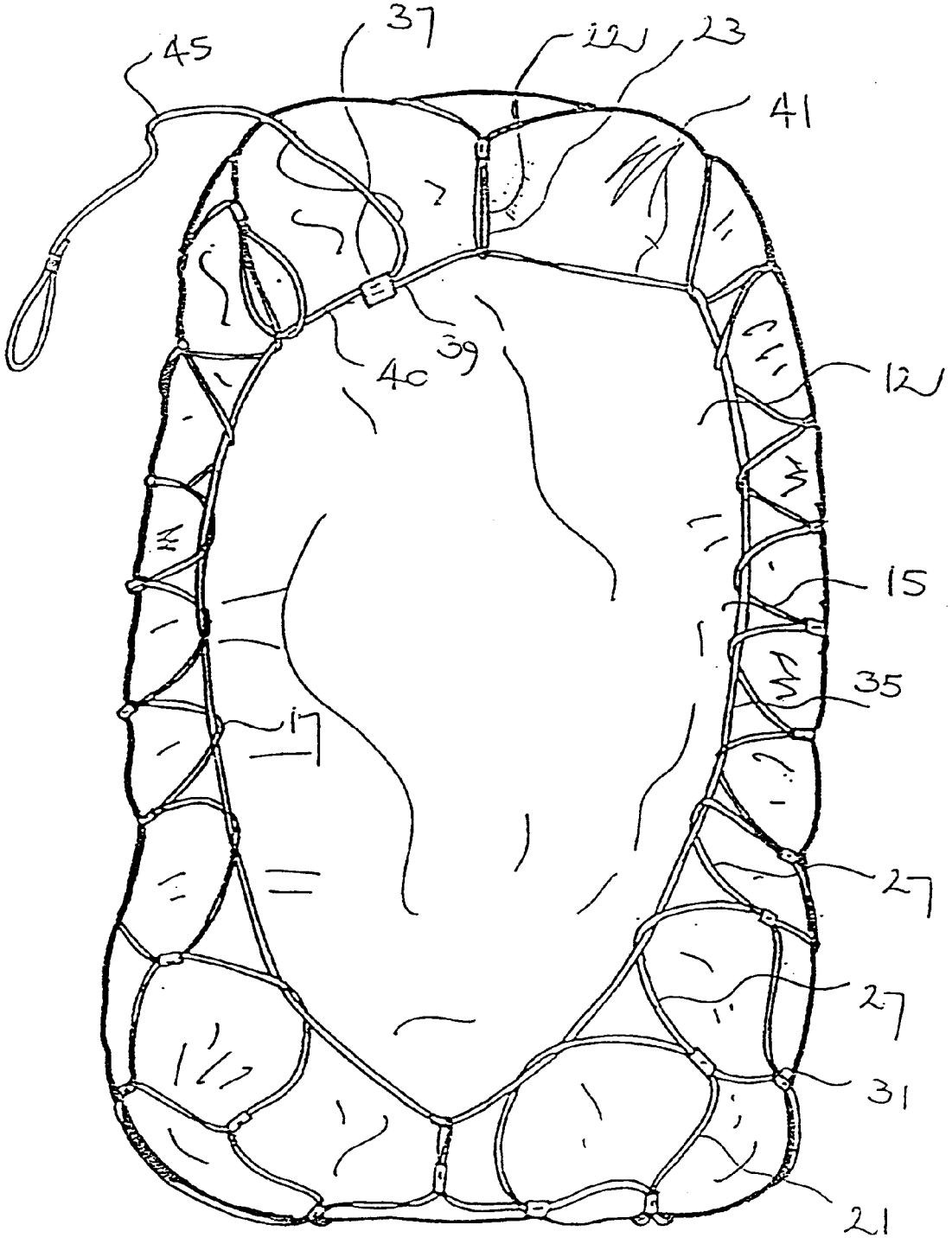
FIG. 2 is a front view of the backpack fitted with the security device.

A draw line 35 in the form of a wire cable is threaded through the loop 23 and the loops 27, as shown in FIG. 2 of the drawings. A locking mechanism 37 is provided for locking one end section 39 of the draw line 35 to another section 40 of the draw line to provide a closed loop 41 which draws the loops 23 and 27 inwardly towards one another so as to reduce the size of the opening 15. The further section 40 of the draw line is slidable within the locking mechanism 37 in one direction so as to allow the size of the loop 41 to be reduced. This provides a convenient system for reducing the size of the opening 15. The locking mechanism 37, however, resists movement of the further section 40 of the draw line 35 in the reverse direction to allow expansion of the loop 41, unless a release system is operated. The release system is conveniently operable by way of a key.

An end section 45 of the draw line 35 extends beyond the locking mechanism 37 and provides a tether by which the security device 40 can be attached to a fixture such as a fixed post. The end section 45 can be attached directly to the fixture, or be passed around the fixture and returned and releasably secured to the locking mechanism.

In use, the backpack 12 is inserted into the receptacle provided by the cover 13 through the opening 15. The draw line 35 which has been threaded through the loops 23 and 27 to form the closed loop is then constricted by pulling the end section 45 of the draw line. This draws all the peripheral loops inwardly towards one another and so encases the backpack within the receptacle provided by the cover, as shown in FIG. 2.

The cover is so positioned on the backpack 12 that the portion of the backpack which is exposed to the opening 15 bears against the back of the person wearing the backpack. Shoulder straps (not shown in FIG. 2, but shown in FIG. 6) of the backpack pass through the opening 15 allowing the backpack to be worn in the usual manner.

When the backpack is worn by a user, the portion of the backpack 12 exposed through the opening 15 bears against the back of the user and so is not accessible to a thief. The netting structure provided by the cover 13 inhibits unauthorized access to the backpack. In particular, the netting makes it difficult for a thief to open the backpack while it is worn on the back of a user. Furthermore, the netting structure also makes it difficult, and normally impossible, to cut open the netting and hence the backpack, to obtain access to its contents.

When the backpack is removed from the back of a user, the draw line can then be tightened further and tethered to a fixture for security purposes so that the user does not need to maintain hold of the backpack.

Figure 5:
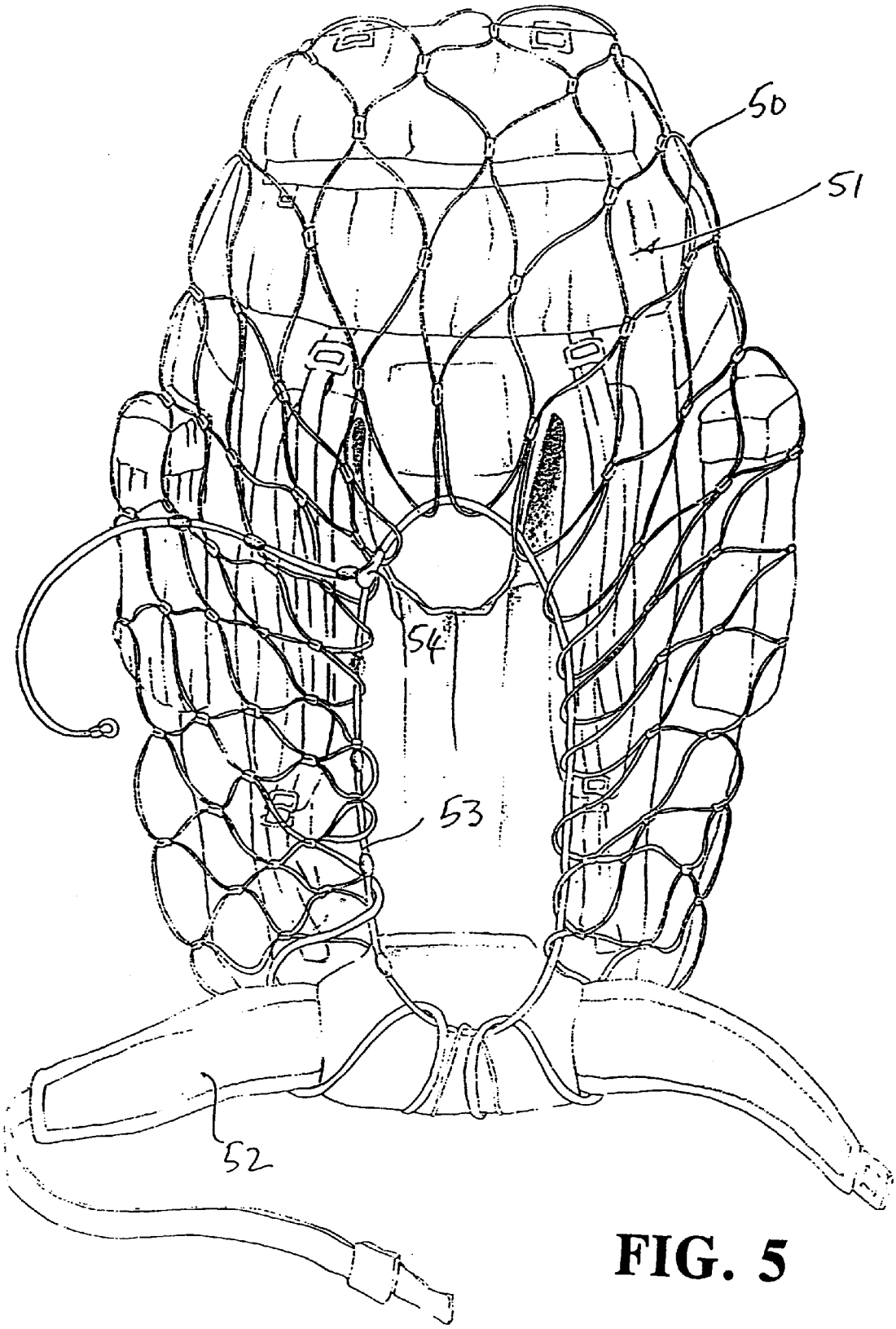
FIG. 5 is a perspective view of another security device in a tightly secured configuration surrounding a backpack.
Figure 6:
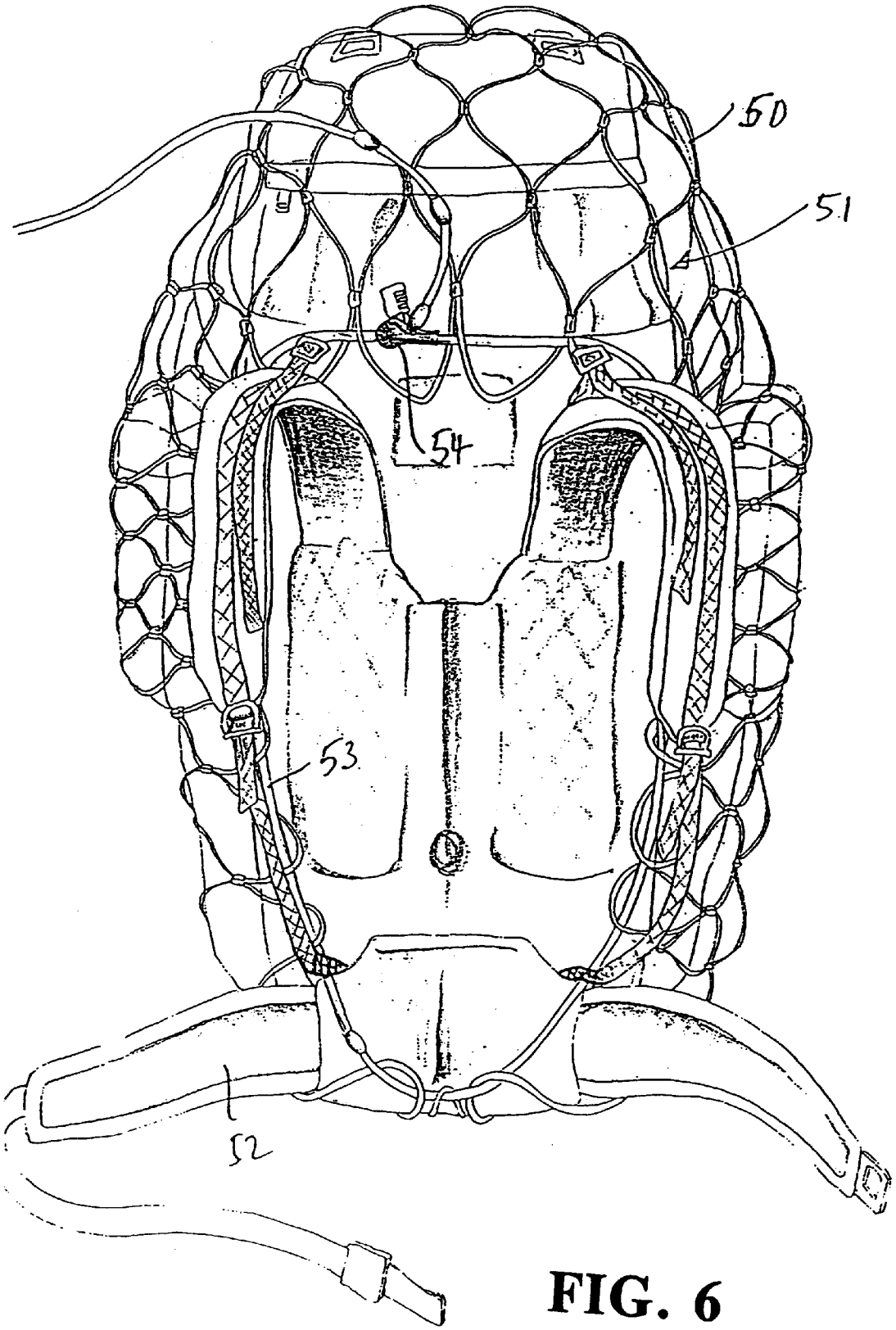
FIG. 6 is a perspective view of the other security device in a looser configuration so that the backpack can be more comfortably worn.

In FIGS. 5 and 6, the security device 50 is generally similar to the cover 13 described earlier. These Figures demonstrate how this security device fits to a backpack 51. It will be noted that three closed loots of thec security device are passed under a waist band 52 of the backpack to ensure that a normal luggage compartment of a backpack, or indeed a sleeping bag, is held well within the security device and the security device cannot be removed from the back of a backpack carrier. A draw line 53 is clearly shown, as well as a locking mechanism 54 (to be described more fully below). In FIG. 5, the draw line is pulled up and secured very tightly as would be required to ensure that no items within the security device can be worked loose and removed. This configuration would be usual when the backpack is not being worn. In contrast in FIG. 6, the draw line is secured in a looser configuration to make the backpack more comfortable to be fitted and carried on the back of a wearer. The security device nevertheless remains just as effective to guard against any attempts to slice open the backpack from behind, and for which purpose the security devices of this invention have been particularly devised.

Figure 7:
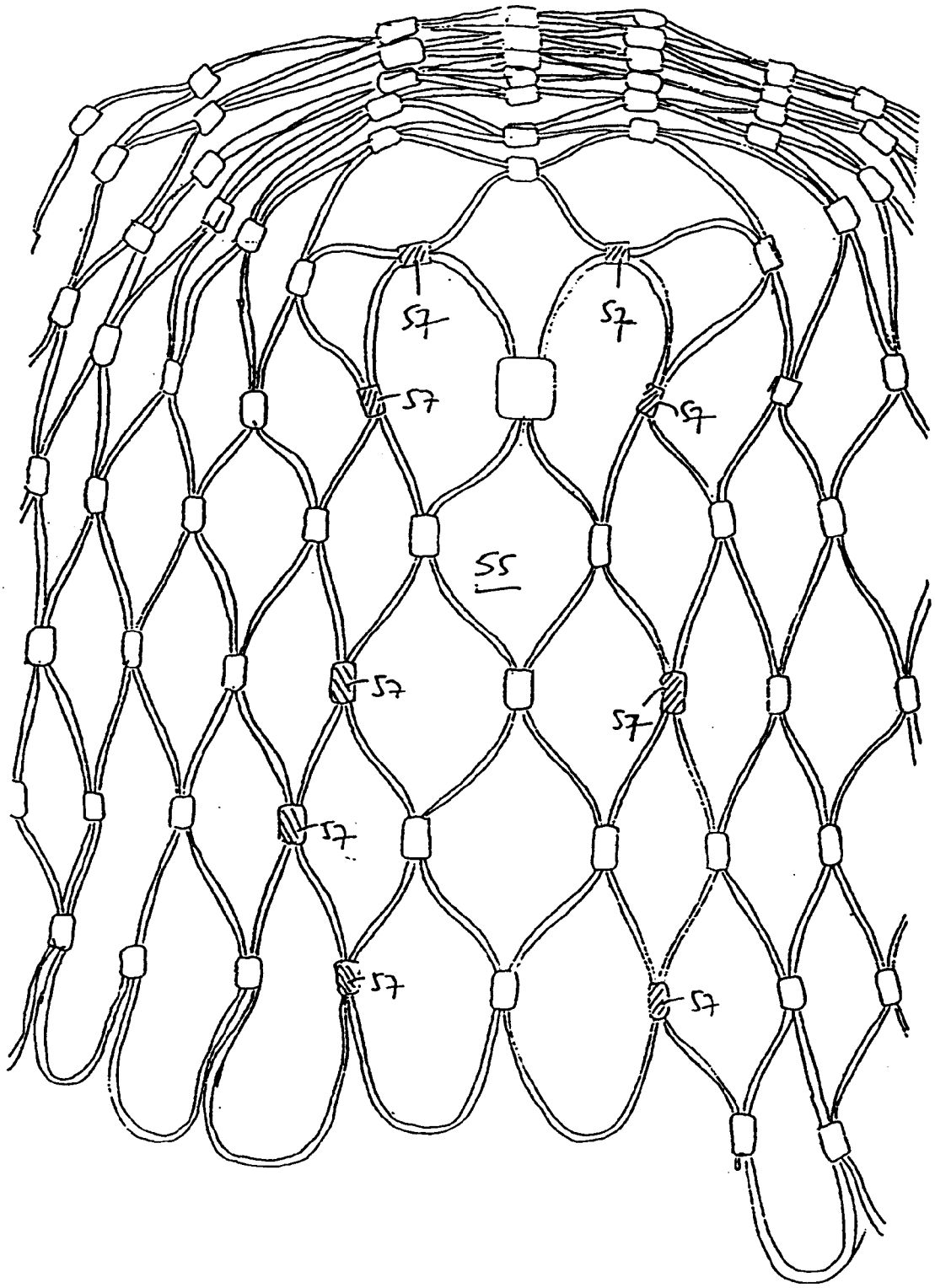
FIG. 7 is a partial view of the other security device particularly illustrating a separate top portion of netting.
Figure 8:
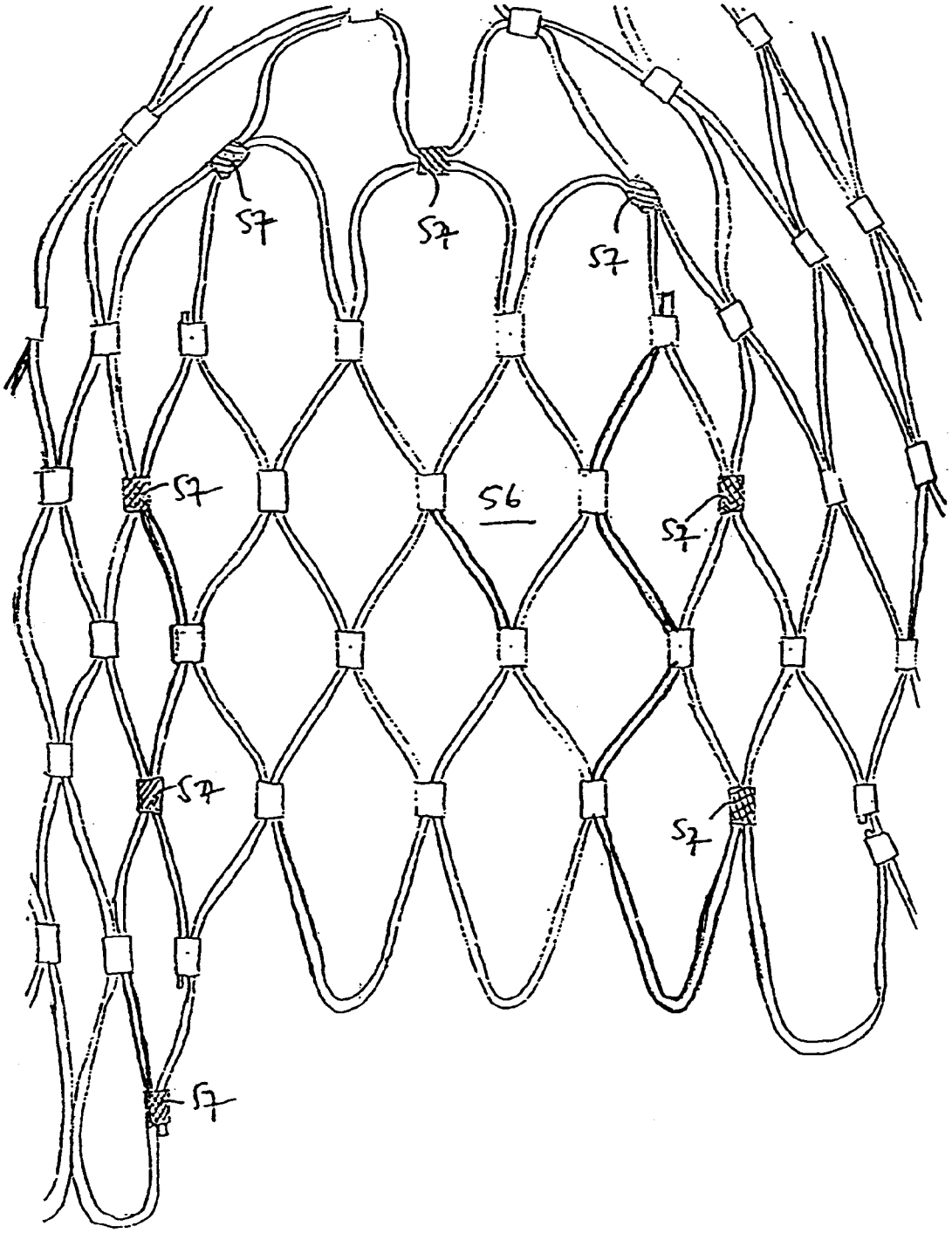
FIG. 8 is a partial view of the other security device particularly illustrating a separate bottom portion of the netting.

It is preferred to make the security device in separate net parts and then join the parts together. Then although the overall shape is designed to fit a range of sizes, this assembly from separate parts enables the overall shape to be more suitable, especially for backpacks or travel packs and similar, and for the same "sized" security devices, to fit a number of different sized backpacks, and/or allow for the insertion of a sleeping bag or separate carrier bag within the security device. FIGS. 7 and 8 show respectively the top part 55 and bottom part 56 of the security device netting. A third part of the netting forms a cover for three (vertical) sides of the backpack and the remaining area, not covered by the netting, comprises the opening to allow the backpack, and sleeping bag where applicable, to enter into the security device as required before the draw line is tightened. In FIGS. 7 and 8, the periphery of the separate parts are each joined by februles 57 (or crimps or moulded beads) to the third part of the netting. The ferrules 57 are however the same or usually the same kind of ferrules or crimps that are used to form the other wire joints in the netting. In general the top and bottom parts tend to elongate sideways in use, and the third cart elongates lengthway, in height, in use.

The top part 55 is made long enough to extend over a large backpack, or over a sleeping bag or mat that may be packed on top of the backpack. For all eventualities the top part 55 extends over normal top backpack flaps, zips and openings, even if a sleeping bag is present. This is to ensure that when the draw line is fully tightened it is not possible to open the backpack through the (closed) opening or work loose any items within the netting. It is clearly seen in FIG. 5 how the draw line 53 is well below the top of the backpack.

It will also be noted that three central strands of the bottom part 56, which are formed of loops of somewhat larger area than elsewhere in the bottom part, extend well over the waist band of the backpacks. This is also to ensure that the central opening is pulled closed beyond (i.e. almost to the top of the waistband) the lowermost end of the netting 50. This likewise prevents loosening and working loose the lower end of the netting.

Figure 9:
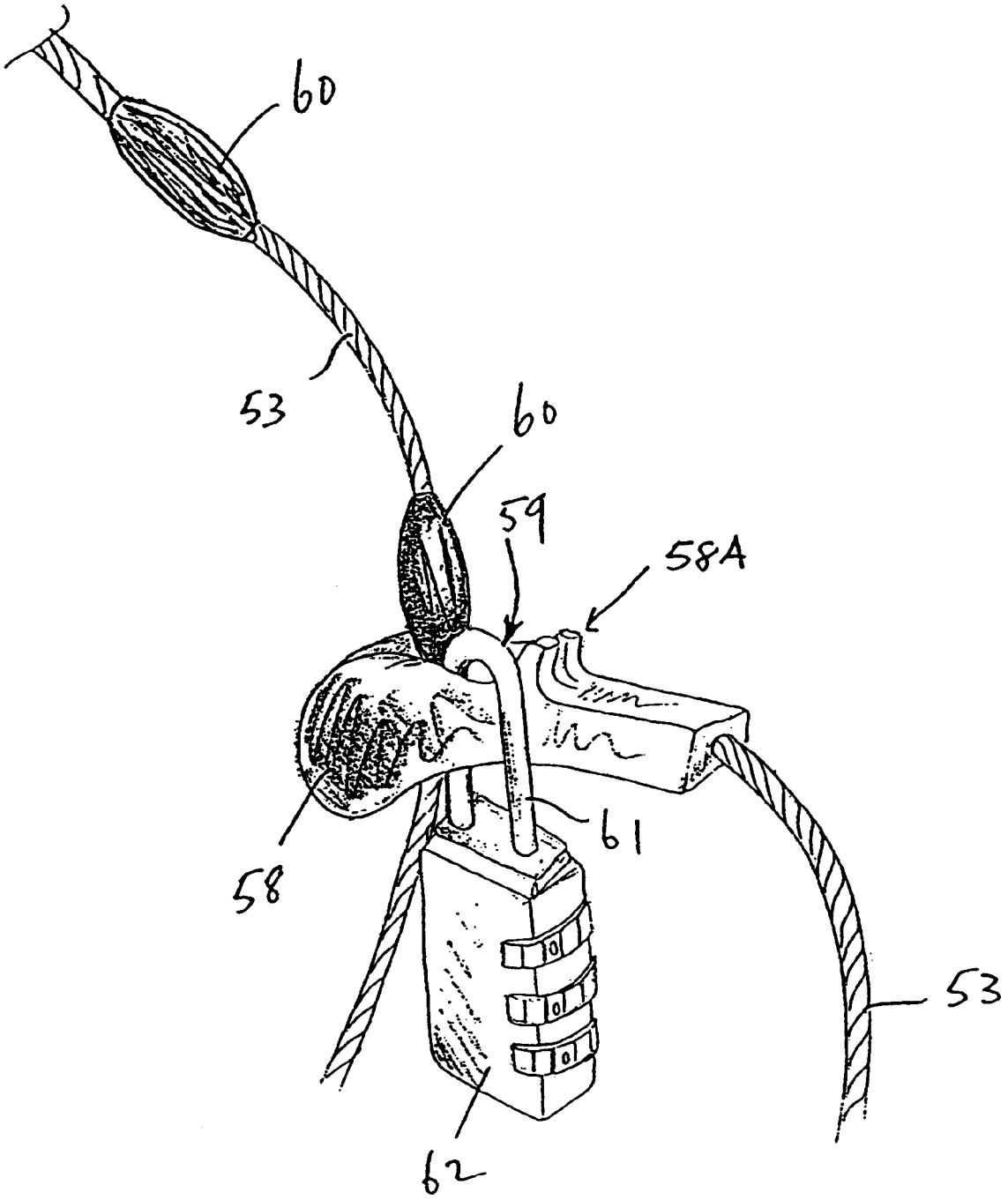
FIG. 9 is an isometric view of a locking mechanism for the security devices.

In FIG. 9, the locking mechanism comprises a body 58, anchored at one end of the draw line 53, which has an aperture 59 through which the draw line 53 can freely pass. Moulded beads 60 fixed at intervals to the line 53 along its length can also snugly pass through the aperture 59. The aperture is shaped and dimensioned to accept a shackle 61 of a padlock 62 such that when the shackle is positioned as shown in FIG. 9, the beads 60 can no longer pass through the aperture. In this way, the locking mechanism prevents the draw line being loosened until the padlock is opened and the shackle 61 is removed. The draw line 53 can be "braked" or restrained at suitable positions along its length by the described locking mechanism by inserting the shackle 61 when an appropriate bead has just passed through the aperture 59.

The aperture 59 has inner arcuate surfaces that allow the draw line to also fit comfortably between upstanding prongs SBA. Any of the beads can fit against the prongs to prevent the draw line being loosened so that without a padlock 62 the draw line can be tightened and held tight by locating an appropriate bead against the prongs 58A. This means the netting is secure for casual use or when the backpack is worn but is not necessarily secure against unauthorized release of the draw line. The anchoring of the bead will prevent opening of the device but such prevention will be more secure if a lock is applied as explained earlier.

It will be appreciated that the draw line 53 serves to close or reduce the size of the opening of the security device and it is possible and sometimes preferable to wrap one or other selected of the open peripheral loops of the netting around the shackle 61 as well. Also for example, if a selected part of the draw line that is generally or normally opposite the locking device across the opening is taken, then (two) strands of the draw line will extend radially across the opening to the lock when the lock 62 is in position to make the opening more secure against any pilfering and cutting open of the backpack through the opening 15 when the back pack is not being worn. The otherwise loose end of the draw line may additionally or alternatively be "threaded" back through some of the open loops for the same purpose.

Other forms of suitable lockable brakes can be used to secure the draw line. Such other forms include a spring 25 loaded split die that allows the wire to pass in only one direction, to tighten the draw line, between the die halves. To release the draw line the spring bias is removed by a manually operable lever, which can also be locked closed by a padlock. A friction drum around which the draw line is wrapped can also be used in which the drum has spokes through which a lock shackle can be inserted to prevent rotation of the drum where required.

Figure 10:
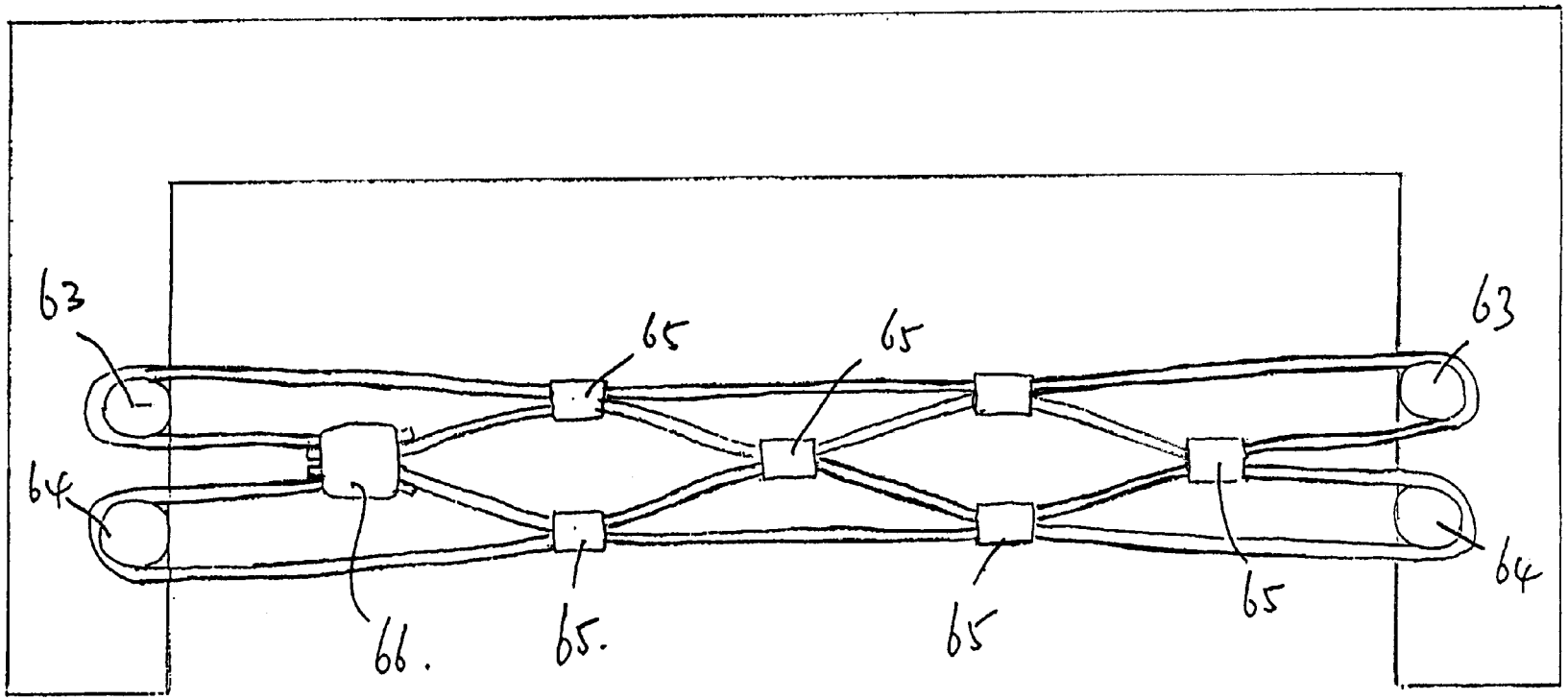
FIG. 10 is an illustrative view of a jig on which the netting can be formed.

In FIG. 10, a jig comprises pairs of opposed pegs 63 and 64. In practice, there is usually several pairs of pegs which are selectively used according to the overall size of netting parts that are required. To form the netting, or sections of netting, wire strands are wrapped around the pegs as shown. At selected intervals, adjacent runs of the wire are brought together side-by-side and then fixed together by metallic crimps 65. An oversize crimp 66 is provided in this example to join the ends of two wire strands together.

In other assembling methods, a single wire strand may be wrapped around moving or static pairs of pegs 63 and 64 in a tortuous path, and usually around several more pairs of pegs, and then likewise held together at intervals and crimped together to form the netting. It will also be noted that the crimping may be wholly or partly achieved using moulded in situ joining techniques. As mentioned earlier, the security device in FIGS. 5 and 6 is preferable made in three separate parts and then joined together after those parts have been removed from the jig or similar respective jigs. The netting is preferably made of 7/7 stainless steel wire which exhibits very limited memory effects. This means that the netting of the finished security device can be readily folded and stored without adopting permanent or detrimental shape distortions.

Figure 11:
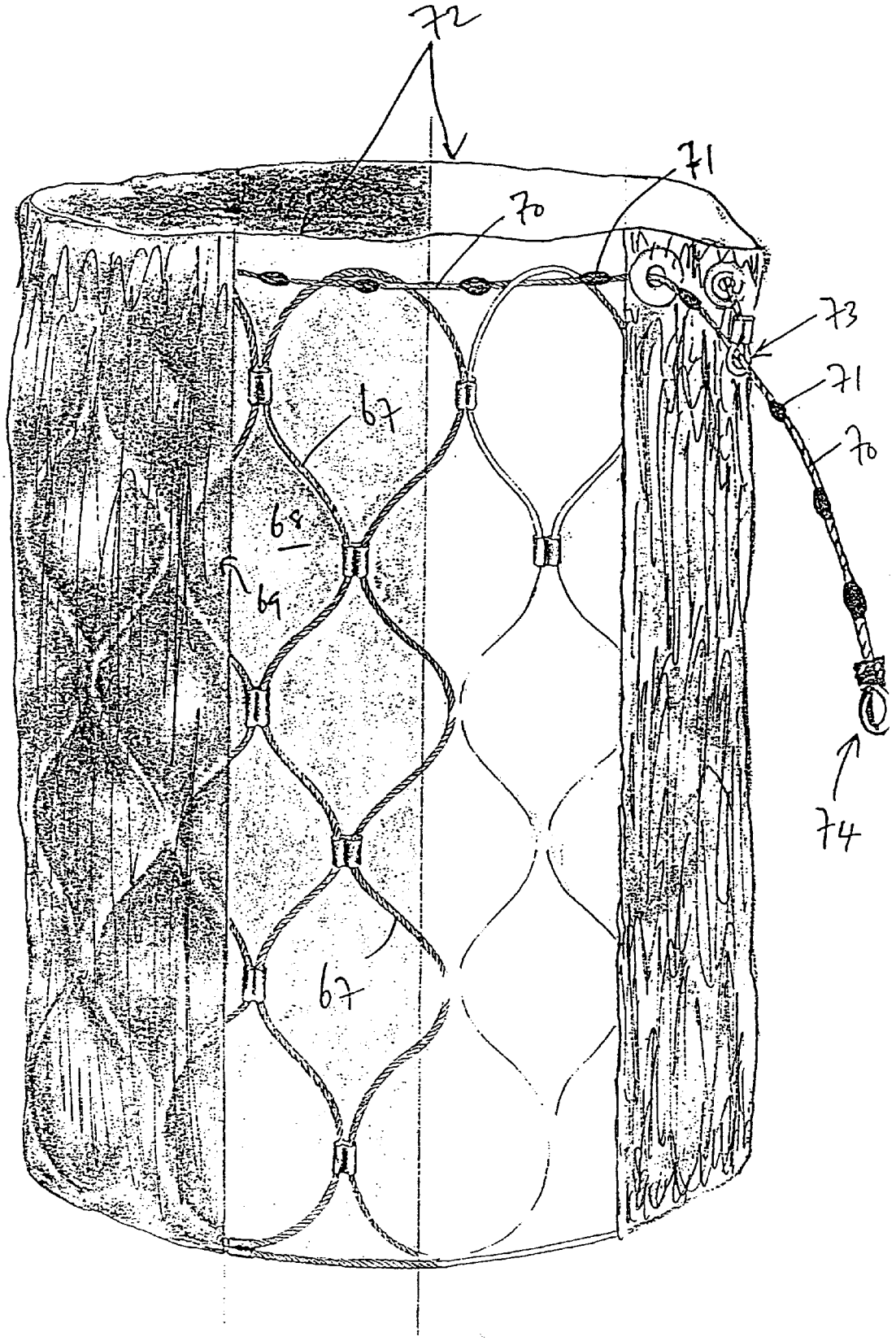
FIG. 11 is a partially cut-away view of a further security device.

In FIG. 11, a security device that is in the form of a container for luggage, and separate small items if desired, is shown. A cover or netting 67 is supported between two layers of canvas material 68 and 69. (Other materials including plastic may also or alternatively be used). The netting is normally loosely stitched to the canvas, or the netting may be glued to one or both of the layers if preferred. A draw line 70, with suitably positioned ferrules 71 along its length or our ferrule in some cases is provided. The draw line fits through closed end loops of the netting adjacent and around a top opening perimeter 72 of the container. One end of the draw line 70 is formed into and held in a loop 73 in a similar manner as described in FIG. 9. The ferrules can pass through the loop 73 to allow the draw line to be tightened to close (or reduce) the top opening of the container. The draw line is made secure by inserting a lock shackle, for example, into the loop 73, in a manner similar to the locking arrangement described earlier. The described container shown in FIG. 11 can be securely closed in this way and cannot be easily tampered with, and especially cannot be sliced open with a knife. A remote end 74 of the draw wire 70 can be used to secure the closed container to a fixed object so that this form of the security device shown in FIG. 11 can also, within reason, be left securely unattended without risk of removal or tampering by cutting open the container.

What is claimed is:

1. A security device for preventing removal of an unsecured item comprising:

a. a mesh bag having an opening therein;

b. a draw line having at least a portion strung through the mesh, wherein:

(1) the draw line has a length terminating in opposing ends, (2) a loop is defined on the draw line through which one of the ends of the draw line extends, whereby the draw line passes through the loop, (3) the draw line has one or more discrete areas of enlarged circumference situated along said length, each such enlarged area being sized to allow passage of said enlarged area through the loop when the draw line is pulled through;

c. a lock having a lock member insertable into the loop, wherein the loop in the draw line is sized such that insertion of the lock member therein adjacent the draw line fills the loop to such an extent that the areas of enlarged circumference on the draw line can no longer be pulled back through the loop to loosen the draw line, but wherein the draw line may be further tightened.

2. The security device of claim 1 wherein at least one of the areas of enlarged circumference is a bead situated on the draw line.

3. A security device for enclosing an article which is not anchored to its surroundings, the security device comprising:

a. a bag having an opening therein;

b. a length of draw line extending from the bag, wherein the draw line:

c. may be pulled to close the opening in the bag, and d. includes one or more discrete areas of enlarged circumference situated along said length, e. a locking body having an aperture defined therein, with the aperture accommodating the draw line and allowing passage of said areas of enlarged circumference; and f. locking means insertable into the aperture to rest adjacent the draw line, the locking means filling the aperture to such an extent that the areas of enlarged circumference can no longer pass back through the aperture to loosen the draw line, but wherein the draw line may be further tightened.

4. The security device of claim 3 wherein the locking body is affixed to the draw line.

* * * * *